United States Patent [19]

Kojima et al.

[11] Patent Number: 4,839,270

[45] Date of Patent: Jun. 13, 1989

[54] RAPIDLY PROCESSABLE SILVER HALIDE PHOTOGRAPHIC LIGHT-SENSITIVE MATERIAL

[75] Inventors: Takaaki Kojima; Mitsuhiro Okumura, both of Hino, Japan

[73] Assignee: Konishiroku Photo Industry Co., Ltd., Tokyo, Japan

[21] Appl. No.: 80,298

[22] Filed: Jul. 31, 1987

[30] Foreign Application Priority Data

Aug. 13, 1986 [JP] Japan ..... 61-189926
Aug. 14, 1986 [JP] Japan ..... 61-191104

[51] Int. Cl.[4] ..... G03C 1/19; G03C 1/34

[52] U.S. Cl. ..... 430/583; 430/611; 430/576

[58] Field of Search ..... 430/576, 611, 583

[56] References Cited

U.S. PATENT DOCUMENTS

| | | | |
|---|---|---|---|
| 3,287,136 | 11/1966 | McBride | 430/611 |
| 3,776,738 | 12/1973 | Ohlschlager | 430/576 |
| 4,097,284 | 6/1978 | Tani | 430/576 |
| 4,147,542 | 4/1979 | Habu et al. | 430/583 |
| 4,336,321 | 6/1982 | Kanada et al. | 430/611 |
| 4,610,954 | 9/1986 | Torigoe et al. | 430/611 |

*Primary Examiner*—Paul R. Michl
*Assistant Examiner*—Lee C. Wright
*Attorney, Agent, or Firm*—Jordan B. Bierman

[57] ABSTRACT

A rapidly processable silver halide photograpic light-sensitive material is disclosed, which comprises a support having thereon at least one silver halide emulsion layer comprising, (a) silver halide grains comprising not less than 80 mol % of silver chloride, (b) at least one optical sensitizing dye represented by the following general formula [I] and (c) at least one compound represented by the following general formula [II]. The photographic material has a high sensitivity, lowered fog and excellent storage stability.

General formula [I]

General formula [II]

12 Claims, No Drawings

RAPIDLY PROCESSABLE SILVER HALIDE PHOTOGRAPHIC LIGHT-SENSITIVE MATERIAL

FIELD OF THE INVENTION

The present invention relates to a silver halide photographic light-sensitive material, and, in particular, to a silver halide photographic light-sensitive material having silver halide emulsion layers containg silver halide grains substantially composed of silver chloride and being capable the rapid treatment, and enabling the provision of a high quality image even with the rapid processing.

BACKGROUND OF THE INVENTION

There has been a demand for the decrease in the developing time in relation to the silver halide photographic light-sensitive material, thus the demand for the development of light-sensitive materials ensuring the more rapid treatment.

It is known that a light-sensitive material comprising silver halide grains involving larger silver chloride content can enabling the rapid developing processing, and that such a material shows a considerably high developing speed under a specific condition, wherein, for example, no bromide content is allowed in the material.

However, though a light-sensitive material having silver halide grains involving a larger silver chloride content is suitable for the rapid treatment, its sensitivity is disadvantageously low. This disadvantage arises from a characteristic of silver shloride; it only absorbs little, if any, visible light. To solve this disadvantage, a variety of sensitizing means are required. The chemical sensitization of grains involving a high silver chloride content readily causes fogging, and when raw samples (raw samples prior to exposure) are stored for a longer period, the fogging may increase, thus deteriorating the sensitivity.

At the same time, an anti-fogging agent is usually added into a silver halide emulsion to prevent the fogging. Such an anti-fogging agent usually deteriorates the sensitivity of the emulsion, therefore, it is disadvantageous to incorporate an anti-fogging agent, as mentioned above, into an emulsion possessing high silver chloride content and being inherently low in the sensitivity. Therefore, when using an anti-fogging agent, it is mandatory to provide the emulsion with the effective sensitization means. However, it is the reality that the incorporation of an anti-fogging agent into an emulsion possessing a high silver chloride content makes the sensitization means less effective. Particularly, when a conventionally known fogging restrainer such as tetrazaindene or mercapto compound which is readily adsorbed onto silver halide grains is used, the sensitizing dye is desorbed by such a compound, deteriorating the sensitization effect, even if the grains have been sensitized with the sensitizing dye. This tendency is especially significant with an emulsion having a high silver chloride content.

To solve this dilemma, it is theoretically possible to develop either a sensitizing agent exerting an effective sensitizing power upon an emulsion possessing a high silver chloride content and the sensitizing effect thereof is not lost by any fogging restrainers, or to develop a fogging restrainer being capable of exerting effective anti-fogging power upon an emulsion possessing a high silver chloride content, and having no adverse effects upon any sentitizing function. However, it is extremely difficult to realize such a sensitizing agent or a fogging restrainer. Accordingly, there is no alternative but to discover the combination of a sensitizing agent and a fogging restrainer each of which being capable of fully attaining the function thereof without exerting an adverse effect on the counterpart. However, there are diverse varieties of compounds known as sensitizing agents, even when the application is limited only to those for an emulsion having a high silver chloride content, and at the same time, there are various fogging restrainers. Therefore, it has been extremely difficult to discover the combination of a sensitizing agent and a fogging restrainer each of which being capable of fully achieving the advantage thereof as well as compensating the disadvantages of the counterpart.

At the end of continued and devoting studies, the inventors have successfully discovered that the satisfactory sensitization is achieved by incorporating a certain spectral sensitizing dye into an emulsion having a high silver chloride content, and simultaneously, by using a certain mercapto compound as a fogging restrainer, and that, accordingly, the fogging is satisfactorily inhibited without reducing the effect of the sensitization.

SUMMARY OF THE INVENTION

The above mentioned disadvantages of a prior art are solved by a silver halide photographic light-sensitive material comprising a support having thereon at least one silver halide emulsion layer comprising (a) silver halide grains comprising not less than 80 mol % of silver chloride, (b) at least one optical sensitizing dye represented by the following general formula [I], and (c) at least one compound represented by the following general formula [II]:

General formula [I]

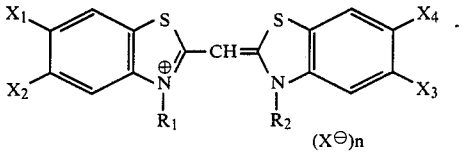

wherein $X_1$, $X_2$, $X_3$ and $X_4$ are a hydrogen atom, a halogen atom, an alkyl group, an alkoxy group, an aryl group or a hydroxy group, respectively; $R_1$ and $R_2$ are an alkyl group, respectively; $X^{\ominus}$ is a counter anion and n is 0 or 1, General formula [II]

General formula [II]

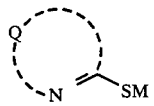

wherein Q is an atomic group necessary for completing a five-membered heterocyclic ring, a five-membered heterocyclic ring condensed with a benzene ring or a 1,3,5-triazine ring and M is a hydrogen atom, an alkali atom or an ammonium group.

DETAILED DESCRIPTION OF THE INVENTION

Having the above-mentioned constitution, a silver halide photographic light-sensitive material according to the present invention, is suitable for the rapid treatment and has high sensitivity and seldom develops fogging, and, additionally, since the increase in fogging as well as the loss in sensitivity are inhibited even if a raw sample is stored for a long time prior to exposure, the light-sensitive material features an excellent shelf-life.

Though remarkably effective as a sensitizing agent, a spectral sensitizing dye represented by the above-mentioned formula [I] readily increases fogging when incorporated into an emulsion a high silver chloride content, in particularly, with a light-sensitive material stored for a long time. In contrast, if such a dye is used jointly with a compound represented by the above-mentioned formula [II], the fogging problem is solved, and, furthermore, the compound represented by the formula [II] does not deteriorate the sensitization effect.

A compound represented by the above-mentioned formula [II] is a kind of meracapto compound. An ordinary mercapto compound has disadvantages: an addition of an amount of the compound enough to inhibit fogging deteriorates the sensitivity; though effective in inhibiting fogging immediatedly after the emulsion is applied, the compound shows no effect after a prolonged storage, and; the compound deteriorates the sensitivity of an emulsion having a high silver chloride content. In contrast, the mercapto compound represented by general formula [II] exhibits an excellent fogging inhibition effect even with a light-sensitive material having been stored for a prolonged period, and furthermore, the compound does not jeopardize the sensitizing effect upon an emulsion having a high silver chloride content by a sensitizing dye represented by general formula [I]. In essence, the similar compound can effectively achieve the sensitization of such an emulsion.

As can be understood from the description, above, it is an astonishing fact that the combination of a sensitizing dye represented by formula [I] and a compound represented by formula [II] have a unique interdependency between them, whereby one does not adversely affect the advantages of the counterpart, while they compensate the disadvantages of the counterpart. It is surprising to find such sensitizing dye as well as a fogging restrainer jointly constitute such interdependency.

As one preferred embodiment of the present invention, a gold-sulfur sensitization may be additionally incorporated. Though advantageous for high sensitization, the gold-sulfur sensitization disadvantageously increases the fogging, especially, that arisen from a prolonged storage. According to the present invention, however, such an increase in fogging is inhibited, and, accordingly, enabling the gold-sulfur sensitization to be favorably incorporated. The gold-sulfur sensitization is particularly effective for the rapid treatment.

The constituents of the present invention is hereinunder discribed more specifically.

According to the invention, a silver halide emulsion layer (such an emulsion layer is, for convenience of description, hereinafter conveniently referred to as silver halide emulsion layer of the present invention contains the above-mentioned silver halide grains involving not less than 80% silver chloride, spectral sensitizing dye represented by general formula [I] and a compound represented by general formula[II]. When a light-sensitive material of the invention is embodied by the constitution having one silver halide emulsion layer, the layer contains all of the above-mentioned compounds and the like. When the light-sensitive material of the invention is embodied by the constitution having a plurality of silver halide emulsion layers, it is sufficient that at least one of any of the layers is a silver halide emulsion layer according to the invention. Usually, it is preferable to incorporate the constitution of the invention into a blue-sensitive emulsion layer, which is formed as the bottom layer (a layer closest to a support), and to make this layer as a silver halide emulsion layer of the invention.

If a light-sensitive material according to the invention has a plurality of silver halide emulsion layers, it is quite natural that there may be emulsion layers not in compliance with the constitution of the silver halide emulsion layer of the invention.

Next, a spectral sensitizing dye represented by general formula [I] and incorporated into the silver halide emulsion layer of the invention is described below.

General formula [I]

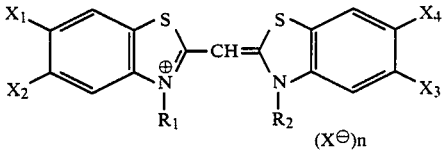

With a spectral sensitizing dye used in the invention and represented by the formula [I], $X_1$, $X_2$, $X_3$ and $X_4$ independently represent any of hydrogen atom, halogen atom, alkyl group, alkoxy group, aryl group and hydroxyl group. More specifically, such a halogen atom is, for example, a chlorine atom, and, as an alkyl group, a methyl group, ethyl group and the like each having one through six carbon atoms are, for example, available. Such an alkoxy group is typified by a methoxy group, ethoxy group or the like each having one through six cabon atoms. Preferably, at least one of $X_1$, $X_2$, $X_3$ and $X_4$ is a chlorine atom, and, most favorably, two of them are chlorine atoms.

In this formula, $R_1$ and $R_2$ independently represent an alkyl group, which may have a substituent. The definition of preferred dye is as follows: whose $R_1$ and $R_2$ are any of unsubstituted alkyl groups or carboxyl- or sulfo-substituted alkyl groups, and, more specifically, carboxyl- or sulfo-substituted alkyl groups, and most specifically, sulfoalkyl groups and carboxylalkyl groups each having one through four carbon atoms.

$R_1$ and $R_2$ may be either identical or different, and, preferably, at least one of them is a carboxyl-substituted alkyl group having one through four carbon atoms.

$X^{\ominus}$ represents a counter anion. Though not compulsory, the example includes halogen ions (such as $Br^-$, $I^-$ and the like) and the like.

n represents 0 or 1.

Spectral sentitizing dyes represented by the general formula [I] are individually known compounds and can be easily synthesized by referring to, for instance, each specification of British Patent No. 660408 and U.S. Pat. No. 3,149,105, Japanese Patent Publication Open to Public Inspection No. 4127/1975 (hereinafter referred to as Japanese Patent O.P.I. Publication) or to "The Cyanine Dyes and Related Compounds" by F. M. Hamer, (Interscience Publisher, New York, 1969), Paragraphs 32–76.

The typical examples of spectral sensitizing dyes represented by general formula and used in the present invention are listed in the following Table - 1. However, it should be noted that the compounds usable in accordance with the invention are not limited only to these examples.

General formula [I]

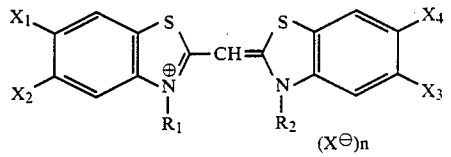

[TABLE-1]

| Compound No. | $X_1$ | $X_2$ | $R_1$ | $R_2$ | $X_3$ | $X_4$ | $X^{\ominus}$ |
|---|---|---|---|---|---|---|---|
| I-1 | H | —Cl | $(CH_2)_3SO_3^{\ominus}$ | $(CH_2)_3SO_3H.NEt_3$ | —Cl | H | — |
| I-2 | H | $CH_3O$— | $(CH_2)_3SO_3^{\ominus}$ | $(CH_2)_3SO_3Na$ | —$OCH_3$ | H | — |
| I-3 | H | —$CH_3$ | $(CH_2)_3SO_3^{\ominus}$ | $(CH_2)_3SO_3H.NEt_3$ | —$CH_3$ | H | — |
| I-4 | H | H | $(CH_2)_3SO_3^{\ominus}$ | $(CH_2)_2SO_3H.NEt_3$ | —$CH_3$ | —$CH_3$ | — |
| I-5 | H | —Cl | $(CH_2)_3SO_3^{\ominus}$ | $(CH_2)_2SO_3H$ | —Cl | H | — |
| I-6 | H | —Cl | $(CH_2)_2SO_3^{\ominus}$ | $(CH_2)_3SO_3H$ | —$CH_3$ | H | — |
| I-7 | H | H | $(CH_2)_2SO_3^{\ominus}$ | $(CH_2)_2SO_3H$ | H | H | — |
| I-8 | H | —Cl | $(CH_2)_2SO_3^{\ominus}$ | $CH_2COOH$ | —Cl | H | — |
| I-9 | H | —$CH_3$ | $(CH_2)_2SO_3^{\ominus}$ | $(CH_2)_2SO_3Na$ | —Cl | H | — |
| I-10 | H | —Cl | $(CH_2)_2COO^{\ominus}$ | $(CH_2)_2COOH$ | —Cl | H | — |
| I-11 | H | H | $(CH_2)CH(CH_3)SO_3^{\ominus}$ | $CH_2$—CH=$CH_2$ | H | H | — |
| I-12 | H | —Cl | $(CH_2)_3SO_3^{\ominus}$ | $CH_2COOH$ | —Cl | H | — |
| I-13 | H | —Cl | $(CH_2)_3SO_3^{\ominus}$ | $CH_2COOH$ | —$CH_3$ | H | — |
| I-14 | H | —Cl | $(CH_2)_3COO^{\ominus}$ | $(CH_2)_2SO_3H$ | —$CH_3$ | H | — |
| I-15 | H | $CH_3O$— | $(CH_2)_4SO_3^{\ominus}$ | $(CH_2)_2COOH$ | H | H | — |
| I-16 | —$CH_3$ | H | $(CH_2)_3COO^{\ominus}$ | $CH_2COOH$ | H | H | — |
| I-17 | H | H | $(CH_2)_3SO_3^{\ominus}$ | $(CH_2)_2SO_3Na$ | H | H | — |

[TABLE-1]-continued

| Compound No. | $X_1$ | $X_2$ | $R_1$ | $R_2$ | $X_3$ | $X_4$ | $X^{\ominus}$ |
|---|---|---|---|---|---|---|---|
| I-18 | H | H | $C_2H_5$ | $CH_2COOH$ | H | H | $Br^{\ominus}$ |
| I-19 | H | H | $C_2H_5$ | $(CH_2)_2SO_3H$ | H | H | $Br^{\ominus}$ |

In Table - 1, above, $NEt_3$ represents the following;

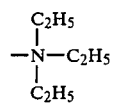

The preferable amount of addition of the above-mentioned spectral sensitizing dye used in the invention is $5\times10^{-6}$ $-5\times10^{-2}$ mol/AgX, more specifically, $1\times10^{-5}-1\times10^{-3}$ mol/AgX, and, most specifically, $1\times10^{-4}-9\times10^{-4}$ mol/AgX.

According to the present invention, the methods known in this art, for instance, can be used to add the spectral sensitizing dye into the emulsion.

For instance, the sensitizing dye can be dispersed directly into the emulsion. Otherwise, into the emulsion the dye may be added in the form of aqueous solution, or a solution prepared by dissolving the dye into a water-soluble solvent, which may be diluted with water if necessary, such as pyridine, methyl alcohol, ethyl alcohol, methyl cellosolve, acetone or the like (or a mixture of the above-mentioned solvents). Furthermore, the use of ultrasonic vibration is effective in dissolving the dye. Additionally, for the spectral sensitizing dye also use a method as described in U.S. Pat. No. 3,469,987, etc., whereby a sensitizing dye is dissolved into a volatile organic solvent, this solution is dispersed into a hydrophilic colloid and then the dispersed matters are added into the emulsion, and a method as described in Japanese Patent Examined Publication No. 24185/1971, etc., whereby a dye insoluble to water is dispersed into a water soluble sovent without being dissolved and then this dispersed liquid is added into the emulsion. Furthermore, the above-mentioned spectral sensitizing dye may be added into the emulsion in accordance with the following methods: a method, as disclosed in U.S. Pat. No. 3,469,987 and others, wherein a dye is dissolved into a volatile organic solvent, and the solution is dispersed into a hydrophilic colloid, then the dispersion is blended into the emulsion; a method, as disclosed in Japanese Patent Examined Publication No. 24185/1971, wherein without being dissolved a dye unsoluble to water is dispersed into a water-soluble solvent, then the dispersion is blended into the emulsion. The spectral sensitizing dye may be added, in the form of dispersion obtainable from the acid dissolution-dispersion process, into the emulsion. The dye may be added into the emulsion in accordance with the methods described in U.S. Pat. Nos. 2,912,345, 3,342,605, 2,996,287, 3,425,835 and others.

In addition, the spectral sensitizing dyes represented by formula [I] may be singly used, or, more than two of them may be combinedly used. When more than two of them are combinedly used, they may be blended into the emulsion at once, or on step-by-step basis. When these dyes are added step by step, the sequence, timing and intervals of addition may be arbitrarily determined in accordance with a requirement. According to the invention, the joint use of the dye as well as other that those represented by general formula [I] is not restricted.

The timing for addition of the above-mentioned spectral sensitizing dye contained in the silver halide emulsion layer of the invention is set arbitrarily at any of the steps within the preparation of the silver halide photographic emulsion. Usually, the spectral sensitizing dye is added after the completion of the first ripening by the completion of the second ripening, and the sensitizing dye may be added in steps respectively corresponding with the above-mentioned timing for addition.

A silver halide emulsion used to form a silver halide emulsion layer of the invention may comprise any of silver chloro-bromide, silver iodo-chloride, silver chloro-iodo-bromide silver, or chloride, but should compulsorily be a high chloride silver halide emulsion containing not less than 80 mol % silver chloride. A silver chloride content of 95–100% is preferable. The emulsion may contain silver iodide, however, the preferred content of which is less than one mol %, and, more specifically, less than 0.5 mol %, and, if there is no silver iodide content, such an emulsion is most advantageous. The preferred content of silver bromide is less than five mol %, or may be zero mol %.

According to the invention, it is preferable that the silver halide grains involving more than 80 mol % silver halide composition form, in terms of weight %, 80%, or, in particular, 100% of the total silver halide grains contained in the silver halide emulsion layers as a whole. Furthermore, it is preferable that the silver chloride content of each of the emulsion layers containing such silver halide grains is, on an average, more than 80 mol %, and, in particular, more than 85 mol %.

That silver halide grains contained in silver halide emulsion layers preferably contain, on an average, more than 80 mol % of silver chloride means that it is satisfactory that a silver chloride mole percentage is, on an average, more than 80% for the emulsion layers as a whole. Naturally, it is possible some of the layers may have a composition other than the above composition, and that some of the layers may contain silver halide grains (such as pure silver bromide) other than those having the above mole percentage.

As mentioned previously, a light-sensitive material of the present invention, when embodied as a structure having a plurality of silver halide emulsion layers, may have emulsion layers respectively having a constitution other than that of the silver halide emulsion layers of the invention. The layers other than those of the invention may not necessarily have a high chloride silver halide composition. However, it is advantageous that the average of silver chloride content for the emulsion layers, as a whole, constituting the light-sensitive material is more than 80 mol %, and, more specifically, that every emulsion layer constituting the light-sensitive material has more than 80 mol % silver chloride. In essence, both on an average for all the layers, as a whole, and with every layer, the silver chloride content is favorably, more than 95 mol %.

The size of silver halide grains used for a photographic light-sensitive material of the invention, that is, the size of silver halide grains (hereinafter referred to as the silver halide grains used in the invention) used for the silver halide emulsion layers of the invention, and for other emulsion layers provided in accordance with a requirement is represented by the length of an edge of a cube, when a silver halide grain is of a cube, or is represented by the length of an edge of a cube having the equivalent volume, when a silver halide grain has a shape other that a cube, such as a sphere. The average grain size F is determined with the expression below;

$$\bar{r} = \frac{\Sigma\, n_i\, r_i}{\Sigma\, n_i}$$

wherein $r_i$ represents the diameter of each grain and $n_i$ represents the number of grains having a grain size of $r_i$ The preferred average grain size of the silver halide grains of the invention is, in terms of the above-mentioned average grain size, less than five μm more specifically, less than three μm, and, most specifically, less than one μm.

The grain size distribution of silver halide grains of the invention may be either multi-dispersed or mono-dispersed type. However, the mono-dispersed emulsion is more advantageous. The term "mono-dispersed" means an emulsion having a coefficient of variation of less than 22%, or, preferably, less than 15% in terms of the size distribution of the silver halide grains contained in the emulsion. The coefficient of variation is a coefficient indicating the range of the grain size distribution and is defined by the following expression:

Standard deviation of seed grains may be identical to or different from a method to grow the grains.

To prepare silver halide grains for silver halide emulsion, both halide ions and silver ions are simultaneously blended together, or, otherwise, into a solution having one such type of ions the other type of ions may be incorporated. In comformity to the critical growth rate of silver halide crystals, silver halide grains may be formed by combinedly adding halide ions and silver ions step by step into a mixing vessel while controlling the pH and pAg in the vessel.

By this method, mono-dispersed silver halide grains having a regular crystal configuration and substantially identical grain size can be obtained. The halogen composition of grains may be modified by means of the conversion method after the grains have satisfactorily grown up.

Any types of silver halide emulsion manufacturing equipment known in the photographic art may be used. In particular, the advantageously used equipment incorporates any of the following methods: a method to introduce both aqueous silver halide solution and aqueous halide salt solution into hydrophylic colloid contained in a mixing vessel via a nozzle immersed in the colloid; a method to continuously vary the concentration of the solution being added into the emulsion; a method, such as ultrafiltration to remove excess water soluble salts and water in the hydrophilic colloid contained in a mixing vessel, so as to prevent the inter-grain distances from becoming too large; and others.

During the course of preparation of the silver halide emulsion of the invention, the grain size, grain configuration, grain size distrubution and the growth rate of the silver halide grains may be regulated by using, in compliance with a requirement, a solvent being capable of dissolving silver halide.

With the silver halide grains used in the silver halide emulsion of the invention, metal atoms in the forms of metallic ions may be integrated into the interior and/or onto the surface of each grain by using at least one type of salt selected from cadmium salt, zinc salt, lead salt, thallium salt, iridium salts (or complex salt containing it), rhodium salt (or complex salt containing it), and iron salt (or complex salt containing it) in the course to form and/or grow the grains, and, additionally, by subjecting the ratio between the {100} face and the {111} face may be arbitrarily selected. Further, each grain may have a composite configuration involving any of the above configurations, and the emulsion may contain various crystal-configurations of grains. However, according to the invention, it is advantageous to use the cubic grains.

As a silver halide emulsion of the invention, a mixture prepared by blending independently prepared more than two types of silver halide emulsions.

It is preferable that silver halide emulsion layers according to the present invention contain an auric sensitizer. The useful auric compounds are, for example, chloroauric acid, sodium chloroaurate, gold potassium thiosulfate, and the like (not limited only to these examples). The preferred amount of auric compound added intergrated into the emulsion layer is $5\times10^{-7}-5\times10^{-3}$ mol, and, more specifically, $2\times10^{-6}-1\times10^{-4}$ mol, and, most specifically, $2.6\times10^{-6}-4\times10^{-5}$ mol, or by far advantageously, $2.6\times10^{-6}-9\times10^{-6}$ mol per mol silver halide.

Although the timing of adding an auric compound into the silver halide emulsion may be an arbitrary stage of the preparation of the emulsion, the preferred timing is any timing between the completion of the formation of silver halide and the completion of chemical sensitization. Also, following the completion of chemical ripening, and after the addition of a compound known as an anti-fogging agent or a stabilizer in the photographic art, and before the silver halide emulsion is actually applied to form the photographic light-sensitive material, the auric compound may be added into the emulsion. In essence, the similar compound is incorporated into the silver halide emulsion at any time point; the timing usually selected to effect sensitization with a gold sensitizer, or any other timing.

Furthermore, it is preferable that silver halide emulsion layer of the invention contain sulfur sensitizers. The examples of useful sulfur sensitizers include sodium thiosulfate, thiourea derivative (for example, diphenythiourea and allylthiourea) and the like (not limited only to these examples). An amount of sulfur sensitizer enough to sensitize the silver halide is used. There is no specific limit of the amount. However, as a guideline, the preferred amount of sodium thiosulfate being added is $1\times10^{-7}-1\times10^{-5}$ mol, or, more specifically, $2\times10^{-6}-8\times10^{-6}$ mol per mol silver halide.

Next, compounds expressed by general formula [II] and used in silver halide emulsion layers of the invention are described below.

The examples of a five-membered heterocycle formed with Q in general formula [II] include the following: an imidazole ring, tetrazole ring, thiazole ring, oxazole ring, selenazole ring, benzimidazole ring, naphthoimidazole ring, benzoselenazole ring, naphthoselenazole ring, benzoxazole ring, naphthoselenazole ring, benzoxazole ring, 1,3,4-oxadiazole ring, 1,3,4-thiadiazole ring, 1,3,4-trazolering and the like.

Particularly preferred compounds among those expressed by general formula [II] can be expressed by the following general formulas [II a] through [II f].

General formula [II a]

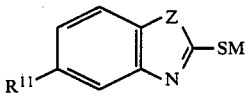

wherein $R_1$ represents any of a hydrogen atom, alkyl group, aryl group, halogen atom, carboxyl group, sulfo group, and salts thereof, and an amino group and an alkoxyl group, and Z represents —NH—, —O— or —S—.

General formula [II b]

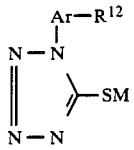

wherein Ar represents any of a phenyl group, naphthyl group cyclohexyl group, and $R_{12}$ represents any of a hydrogen atom, alkyl group, alkoxy group, carboxyl group and sulfo group, each of which may be substituted with Ar, or salts thereof, as well as a hydroxy group, amino group, acylamino group, carbamoyl group and sulfamide group.

General formula [IIc]

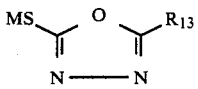

General formula [IId]

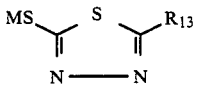

In the formula, $R_{13}$ represents any of a hydrogen atom, alkyl group, aryl group, alkenyl group, cycloalkyl group, $—SR_{14}$, or

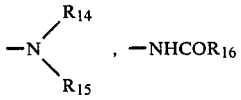

or $—NHSO_2R_{17}$ or heterocyclic group. $R_{14}$ and $R_{15}$ independently represent a hydrogen atom, alkyl group or aryl group. $R_{16}$ and $R_{17}$ independently represent an alkyl group or aryl group.

The examples of alkyl group represented by any of $R_{13}$, $R_{14}$, $R_{15}$, $R_{16}$ and $R_{17}$ in general formulas and include a methyl group, benzyl group, ethyl group, propyl group. The examples of aryl group represented by any of the similar symbols include a phenyl group, naphthyl group and the like.

The examples of alkenyl group represented by $R_{13}$ include propenyl group and the like. The examples of cycloalkenyl group represented by $R_{13}$ include a cyclohexyl group and the like. The examples of heterocyclic group represented by the similar symbol include a furil group, pyridinyl group and the like.

An alkyl group and aryl group independently represented by any of $R_{13}$, $R_{14}$, $R_{15}$, $R_{16}$ and $R_{17}$ may have a substituent. Also, an alkenyl group, cycloalkyl group and heterocyclic group respectively represented by $R_{13}$ may have a substituent.

M represents any of a hydrogen atom, alkali metal atom and ammonium group.

General formula [II e]

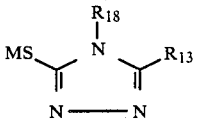

wherein, $R_{18}$ represents any of a hydrogen atom, alkyl cycloalkyl group, alkenyl group, aryl group, —$COR_{19}$ and —$SOR_{20}$, and $R_{19}$ and $R_{20}$ independently represent an alkyl group, aryl group, cycloalkyl group or alkenyl group.

General formula [IIf]

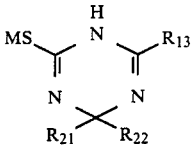

wherein, $R_{21}$ and $R_{22}$ independently represent a group identical to that represented by $R_{14}$ or $R_{15}$ in general formulas [II a] and[IIb].

The typical compounds expressed by general formulas through are listed below. However, as can be understood, the cope of the invention is not limited only to these examples.

[IIa-1]

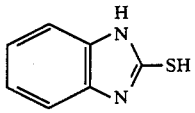

[IIa-2]

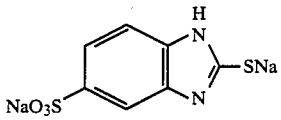

[IIa-3]

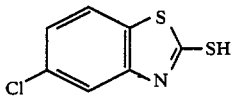

[IIa-4]

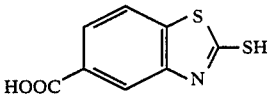

[IIa-5]

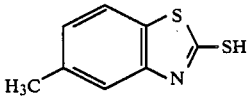

[IIa-6]

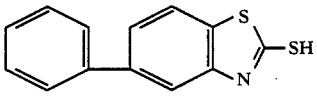

[IIa-7]

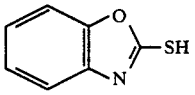

[IIa-8]

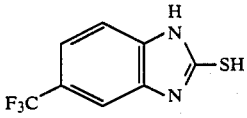

-continued

[IIb-1]

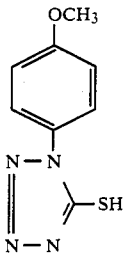

[IIb-2]

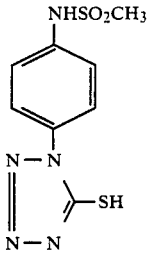

[IIb-3]

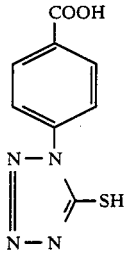

[IIb-4]

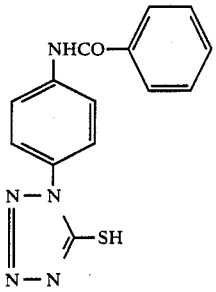

[IIb-5]

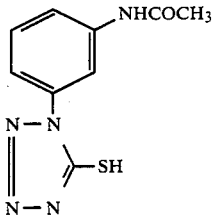

[IIb-6]

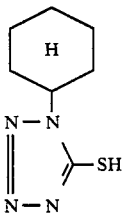

-continued
[IIb-7]
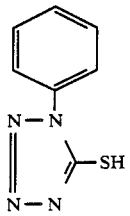
[IIb-8]
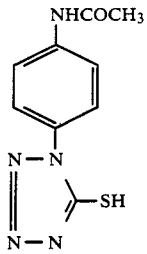
[IIb-9]
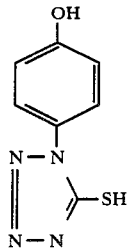
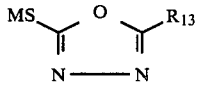
| Example Compound | $R_{13}$ | M |
|---|---|---|
| IIc-1 | $-C_2H_5$ | —H |
| IIc-2 | $-CH_2-CH=CH_2$ | —H |
| IIc-3 | $-CH=CH-CH_2-CH_3$ | —H |
| IIc-4 | $-C_7H_{15}$ | —H |
| IIc-5 | $-C_9H_{19}$ | —Na |
| IIc-6 | 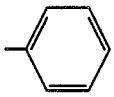 | —H |
| IIc-7 | $-C_4H_9(t)$ | —H |
| IIc-8 | 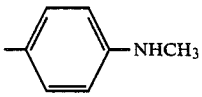 | —H |
| IIc-9 | 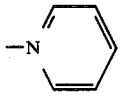 | —H |
| IIc-10 | 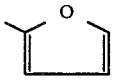 | —H |
-continued
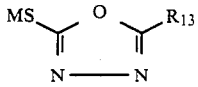
| Example Compound | $R_{13}$ | M |
|---|---|---|
| IIc-11 | 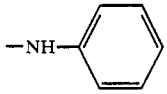 | —H |
| IIc-12 | 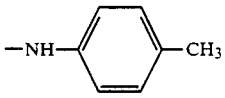 | $-NH_4$ |
| IIc-13 | $-NHCOCH_3$ | —H |
| IIc-14 | 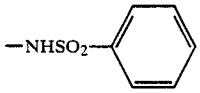 | —H |
| IIc-15 | $-N(CH_3)_2$ | —H |
| IIc-16 | 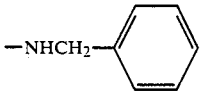 | —H |
| IIc-17 | 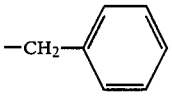 | —H |
| IIc-18 | $-S-CH_3$ | —H |
| IIc-19 | 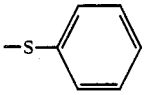 | —H |
| IIc-20 | —SH | —H |
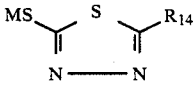
| Example Compound | $R_{14}$ | M |
|---|---|---|
| IId-1 | —H | —H |
| IId-2 | $-C_2H_5$ | —H |
| IId-3 | $-C_4H_9(t)$ | —H |
| IId-4 | $-C_6H_{13}$ | —H |
| IId-5 | 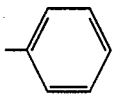 | —H |
| IId-6 | 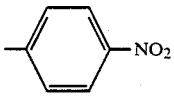 | —H |

-continued
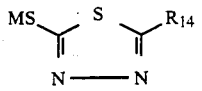
| Example Compound | $R_{14}$ | M |
|---|---|---|
| IId-7 | 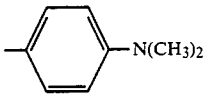 | —H |
| IId-8 | 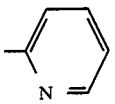 | —H |
| IId-9 | 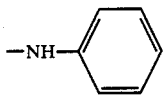 | —H |
| IId-10 | $-N(CH_3)_2$ | —H |
| IId-11 | $-CH_2CH{=}CH_2$ | —H |
| IId-12 | —SH | —H |
| IId-13 | $-NHCOC_2H_5$ | —H |
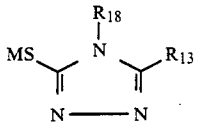
| Example Compound | $R_{13}$ | $R_{18}$ | M |
|---|---|---|---|
| IIe-1 | $-C_2H_5$ | —H | —H |
| IIe-2 | $-CH_3$ | $-CH_3$ | —H |
| IIe-3 | $-CH_3$ | 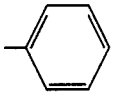 | |
| IIe-4 | $-NHCOCH_3$ | $-CH_3$ | —H |
| IIe-5 | 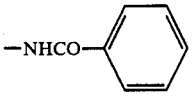 | 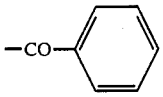 | —H |
| IIe-6 | $-NHCOCH_3$ | $-COCH_3$ | —H |
| IIe-7 | $-NHSO_3CH_3$ | 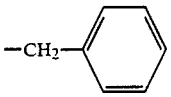 | —H |
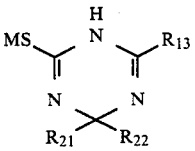
| Example Compound | $R_{13}$ | $R_{21}$ | $R_{22}$ | M |
|---|---|---|---|---|
| IIf-1 | $-C_2H_5$ | $-CH_3$ | $-CH_3$ | —H |
| IIf-2 | 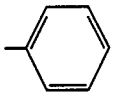 | $-CH_3$ | $-CH_3$ | —H |
| IIf-3 | $-NH_2$ | —H | 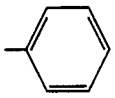 | —H |
| IIf-4 | 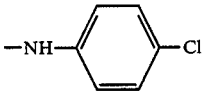 | —H | $-C_4H_9$ | —H |
| IIf-5 | $-NHCOCH_3$ | $-CH_3$ | $-CH_3$ | —H |
| IIf-6 | 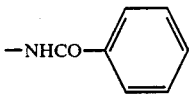 | $-CH_3$ | $-CH_3$ | —H |

-continued

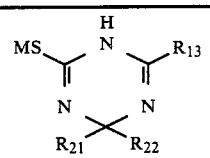

| Example Compound | $R_{13}$ | $R_{21}$ | $R_{22}$ | M |
|---|---|---|---|---|
| IIf-7 | 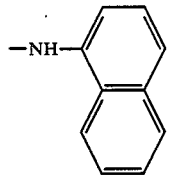 | $-CH_3$ | $-C_3H_7(i)$ | $-H$ |
| IIf-8 | 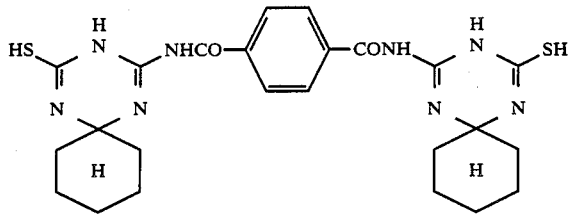 | | | |

The above compounds can be synthesized by referring to the following patents and literatures: Journal of Chemical Society 49, 1748, 1927; Journal of Organic Chemistry 39, 2469, 1965; Japanese Patent O.P.I. Publication 89034/1975; Annalen Chimie, 44–3, 1954; Japanese Patent Examined Publication No. 28496/1965; Chemical Berichte 20, 231, 1887; U.S. Pat. No. 3,259,976 and others.

Additionally, the compounds represented by any of the above variations of general formula [II] include the compounds described in, for example, Chemical and Pharmaceutical Bulletine, Tokyo, Vol. 26, pp. 314 (1978); Japanese Patent O.P.I. Publication No. 79436/1980; Berichte der Deutchen Chemischen Gesellsdraft, 82, pp. 121 (1948); U.S. Pat. Nos. 2,843,491 and 3,017,270; British Patent No. 940,169; Japanese Patent O.P.I. Publications No. 102639/1981 and No. 59463/1980; Journal of American Chemical Society, 44, pp. 1502–1510. The synthesyzing method may be in compliance with those described in these literatures and patent specifications.

To incorporate a compound expressed by general formula [II] (for invention or as a compound [II]) into silver halide emulsion layers, the compound can be firstly dissolved into water or an organic solvent (for instance, methanol, ethanol, etc.), which is capable of being freely blended with water, then the solution is incorporated into the emulsion. The compounds [II] may be used either individually or jointly with different compound expressed by the same formula [II], a stabilizer or a fogging restrainer other than a compound expressed by the same formula [II]. Various stabilizers and fogging restrainers usable in accordance with the invention are described later.

Compound [II] may be made present in forming silver halide grains or may be added after forming silver halide grains. It is preferable that a compound [II] be added upon the completion of silver halide grains. The timing for addition is at or during any of the following time steps: from the completion of formation of silver halide grain nuclei by the initiation of chemical ripening; during the chemical ripening; upon the completion of the chemical ripening; after the completion of the chemical ripening and by the application of emulsion. Preferably, the compound [II] is added into emulsion during or upon the completion of the chemical ripening, or from the completion of the chemical ripening by the application of emulsion. In adding the compound [II], all the required amount may be added into emulsion at once or on the step-by step basis.

In relation to the medium of addition, the compound [II] may be directly added into a silver halide emulsion or a silver halide emulsion coating solution, or may be firstly added into a coating solution for a non-photosensitive hydrophilic for the colloidal layers adjacent to the silver halide emulsion layer of the invention by diffusion at the time of stratified coating and then allowed to diffuse into the silver halide emulsion layer of the invention.

There is no specific amount of addition for the compound [II]. Usually, the amount is $1\times10^{-6}$ to $1\times10^{-1}$ mol, or, favorably, $1\times10^{-5}$ to $1\times10^{-2}$ mol, or, more favorably, $1\times10^{-4}$ to $1\times10^{-3}$ mol per mol silver halide.

Some compounds of the invention represented by formula [II] are the compounds known as stabilizing agents or fog-restrainers in the photographic art, and discribed for example in British Patent No. 1,273,030, Japanese Patent Examined Publication Nos. 9936/1983 and 27010/1985, Japanse Patent O.P.I. Publication Nos. 102639/1976, 22416/1978, 59463/1980, 79436/1980 and 232342/1984, and others.

When using the light-sensitive material of the invention as a color photographic light-sensitive material, a dye-forming coupler being capable of coupling with an oxidized product of a primary aromatic amine developing agent (for example, a derivative of p-phenylenediamine, or a derivative of p-phenylenediamine, or a derivative of p-phenylenediamine, or a aminophenol) and forming a dye in the color developing can be used.

Each emulsion layer composing the light-sensitive material may have a coupler. However, as mentioned previously, a yellow coupler is preferable contained in the silver halide emulsion layer of the invention. The examples of a yellow coupler usable for the invention include those described in the specifications of U.S. Pat. Nos. 2,186,849, 2,322,027, 2,728,658, 2,875,057, 3,265,506, 3,277,155, 3,408,194, 3,415,652, 3,447,928, 3,664,841, 3,770,446, 3,778,277, 3,849,140 and 3,894,875, British Patent Nos. 778,089, 808,276, 875,476, 402,ll, 1,421,126 and 1,513,832, Japanese Patent Examined Publication No. 13576/1974, Japanese Patent O.P.I. Publication Nos. 29432/1973, 66834/1973, 10736/1974, 122335/1974, 28834/1975, 132926/1975, 138832/1975, 3631/1976, 17438/1976, 26038/1976, 26039/1976, 50734/1976, 53825/1976, 755211976, 89728/1976, 102636/1976, 107137/1976, 117031/1976, 122439/1976, 143319/1976, 9529/1978, 82332/1978, 135625/1978, 145619/1978, 23528/1979, 48541/1979, 655035/1979, 133329/1979, 598/1980 and others.

The useful magenta couplers include those described in the specifications of U.S. Pat. Nos. 1,969,479, 2,213,986, 2,294,909, 2,338,677, 2,340,703, 2,359,332, 2,411,951, 2,435,550, 2,592,303, 2,600,788, 2,618,641, 2,619,419, 2,673,801, 2,691,659, 2,803,554, 2,829,975, 2,866,706, 2,881,167, 2,895,826, 3,062,653, 3,127,269, 2,881,167, 2,895,826, 3,062,653, 3,127,269, 3,214 437, 3,253,924, 3,311,476, 3,419,391, 3,486,894, 3,519,429, 3,558,318, 3,617,291, 3,684,514, 3,705,896, 3,725,067, and 3,888,680, British Patent Nos. 720,284, 737,700, 813,866, 92,886, 918,128, 1,019,117, 1,042,832, 1,047,612, 1,398,828 and 1,398,979, West German Patent Official Gazettes Nos. 814,996 and 1,070,030, Belgium Patent No. 724,427, Japanese Patent O.P.I. Publication Nos. 60479/1971, 29639/1974, 111631/1974, 129538/1974, 13041/1975, 116471/1975, 59336/1975, 3232/1976, 3233/1976, 10935/1976, 16924/1976, 20826/1976, 26541/1976, 0228/1976, 36938/1976, 37230/1976, 37646/1976, 39039/1976, 44927/1976, 104344/1976, 05820/1976, 108842/1976, 112341/1976, 12342/1976, 112343/1976, 112344/1976, 17032/1976, 126831/1976, 31738/1977, 9122/1978, 35122/1978, 75930/1978, 86214/1978, 5835/1978, 123129/1978 and 56429/1979.

The useful cyan couplers include those described in the specifications of U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476, 563, 3,737,316, 3,758,308 and 3,839,044, British Patent Nos. 478,991, 945,542, 1,084,480, 1,377,233, 1,388,024 and 1,543,040, Japanese Patent O.P.I. Publications Nos. 37425/1972, 10135/1975, 25228/1975, 112038/1975, 117422/1975, 130441/1975, 6551/1976, 37647/1976, 52828/1976 108841/1976, 109630/1978, 48237/1979, 66129/1979, 131931/1979 and 32071/1980, and others.

The couplers being capable of forming a coupling product having a maximum spectral absorption wavelength in the range of from 700 to 854 μm include those described in Japanese Patent Examined Publication No. 24849/1977, Japanese Patent O.P.I. Publications Nos. 125836/1978, 129036/1978, 21094/1980, 21095/1980, 21096/1980, and others.

The above-mentioned couplers are introduced into a silver halide emulsion by using a high boiling organic solvent and a dispersing agent.

Into a silver halide photographic light-sensitive material of the invention may be incorporated various compounds in addition to the compound represented by general formula [II], in order to prevent the fogging during the manufacturing process, storage and developing process of the material, and to stabilize the photographic performance thereof.

The diverse examples of such compounds useful for this purpose, known anti-fogging agents as well as stabilizer, are as follows: tetrazaindenes; azoles such as benzothiazolium salts, nitroindazoles, nitrobenzimidazoles, chlorobenzimidazoles, bromobenzimidazoles, aminotriazoles, benzotriazoles, nitrobenzotriazoles, benzenethiosulfinic acid; benzenesulfinic acid; amide benzenesulfonate; hydroquinone derivatives; aminophenol derivatives; gallic derivatives; ascorbic derivatives; and others.

The scope of useful hydrophilic colloid for forming hydrophilic colloidal layers which compose a silver halide photographic light-sensitive material of the invention is not specifically limited. Accordingly, as a binder for light-sensitive and non-light-sensitive layers, gelatin and various materials may be used in accordance with a requirement. Other than gelatin, the useful materials are as follows: colloidal albumin, agar-agar, gum arabic, dextran, alginic acid; derivative of cellulose such as cellulose acetate hydrolyzed to have 19–26% acetyl content; polyacrylic amide, imidopolyacrylic amide, casein; vinyl alcohol polymer, containing urethanecarboxylic group or cyanoacetyl group, such as vinyl alcohol-vinyl cyanoacetate copolymer; polyvinyl alcohol-polyvinyl pyrrolicinone, hydrolyzed polyvinyl acetate; polymer, obtained by polymerization of protein or saturated acylated protein and a monomer having a vinyl group, such as polyvinyl pyridine, polyvinyl amine, polyamineethylmethacrylate, polyethylene imine, and others.

As the hardener, an arbitrarily selected hardener may be used, the examples of which are as follows: organic hardeners such as vinyl sulfonic, acryloyl, ethyleneimine hardners, and the like; inorganic hardners such as chromic alum, potash alum, and the like. One type of hardener may be singly used, or more than two of them may be combinedly used.

A light-sensitive material of the invention may contain a surface active agent as a coating auxiliary, antistatic agent, slide-improvement emulsification dispersion, adhesion inhibitor, or the like.

The examples of useful surface active agents include saponin, sodium dodecylbenzenesulfonate, sodium sulfosuccinate, and those disclosed in Japanese Patent O.P.I. Publication Nos. 46733/1974, 10722/1974 and 16525/1975.

As an ultraviolet absorbent, benzotriazole compounds, thiazolidone compounds, acrylonitrile compounds, benzophenon compounds, for example, and the like may be used. Also, the light-sensitive material may contain, in accordance with a requirement, antistatic agents, fluorescent whitening agents, oxidation inhibitors, anti-stain agents and the like.

Typically, to prepare a light-sensitive material of the invention, photographic additives are incorporated into the silver halide emulsions, which are then applied onto a support so as to form silver halide emulsion layers. When the coats of the similar layers are formed, they may be formed via a subbing layer, intermediated layers and the like, in accordance with a requirement.

The examples of a support useful for this purpose are as follows: supports made of paper, glass, cellulose acetate, cellulose nitrate, polyester, polyamide, polystrene, and the like; supports made of more than two types of substrates bonded together, such as a lamination of paper and polyolefin (polyethylene, polypropylene and the like); and others. To improve the adhesion to silver halide emulsion layer, such a support is usually subjected to various surface improvement treatments, for instance, the electron impact treatment, or the subbing treatment to provide a subbing layer.

To apply, and then dry silver halide photographic emulsion onto the support, the known coating processes such as the dip coating, roller coating, bead coating, curtain flow coating, and the like are used.

When the invention is embodied as a color photographic light-sensitive material, the developing is effected by a conventional color developing process.

The examples of useful color developer used for color developing are as follows: primary aromatic amine compounds, for example, N-diethyl-p-phenylenediamine, N-ethyl-N-hydroxyethylparaphenylenediamine, 4-(N-ethyl-N-hydroxyethyl) amino-2-methylaniline, 4-(N-ethyl-N-$\beta$-methanesulfonamidethyl) amino-2-methlaniline, 4-(N,N-diethyl) amino-2-methylaniline, 4-(N-ethyl-N-methxyethyl) amino-2-methylaniline, and; sulfates, hydrochlorates, sulfates and p-toluenesulfonates of the above primary aromatic amine compounds, and others.

A color developer, especially, for rapid treatment may contain, in addition to the above-mentioned color developing agent, and N, N-dialkylhydroxylamine salt serving as a preservative, various photographic development additives.

The examples of arbitrarily selected and used additives are as follows: alkali agents such as sodium hydroxide, potassium hydroxide, sodium carbonate, potassium carbonate, sodium metaborate, potassium tertiary phosphate, and the like; pH buffers such as sodium phosphate, potassium dihydrogen phosphate, disodium hydrogen phosphate, potassium bicarbonate, and the like; organic solvents such as methanol, ethylene glycol triethanolamine; and others.

Benzyl alcohol as a color-forming improvement agent may be contained in a color developer, solution, but preferably, should not be contained.

A limited amount of benzyl alcohol may be contained in a color developer. The preferred amount of benzyl alcohol contained in color developer is zero to five ml, or, more specifically, zero to three ml per one l color developer.

It is particularly preferable that a color developer contains, in addition to the above-mentioned N,N-dialkylhydroxylamine, a combination of sulfites such as sodium sulfite and potassium sulfite in order to improve the shelf life of the color developer. The amount of a combination of sulfites is 0.05 to 12 g, or, more specifically, 0.1 to 0.3 g per one l color developer.

Furthermore, it is advantageous that an amount of water soluble bromide serving as a development inhibitor and contained in the color developer of the invention is as small as possible. An extremely small amount of such bromide may be contained in the developer, or, if possible, no such bromide is contained in the developer.

The term "rapid processing" usually refers to the color developing whose processing time is less than 90 seconds, wherein a temperature of color developer is 20° to 50° C., or, preferable, 30° to 40° C.

In the rapid processing, after a dye image has been formed by color developing, it is necessary to remove undeveloped silver halide and developed silver image by means of bleach-fixing.

The preferred bleach-fixing time is less than 90 seconds, and more specifically, less than 60 seconds.

A preferred bleaching agent for developed silver is a metal salt of multivalent organic salt, which is typified by a ferric salt of organic acid. The examples of such a salt are the iron salts of the following acids: nitrilotriacetic acid, diethylenetriaminepentaacetic acid, ethylene glycol bis (aminoethyl ether) tetraacetic acid, diaminopropanol tetraacetic acid, N-(2-hydroxyethyl) ethylenediamine triacetic acid, ethyliminodipropionic acid, cyclohexanediaminetetraacetic acid, ethylenediaminetetraacetic acid, and others. Other useful iron salts include the salts of polycarboxylic acids, disclosed in Japanese Patent O.P.I. Publication No. 107737/1974, such as of oxalic acid, malonic acid, succinic acid, malic acid, tartaric acid, citric acid, salicylic acid and the like. Other than the above-mentioned ferric salts, the salts of multivalent metal such as cupric salt and cobalt salt may be used. Furthermore, inorganic multivalent metal salts such as ferric chloride and ferric sulfate may be used, if necessary, in compliance with a requirement. As a useful fixer, the conventionally known thiosulfate, thiocyanate or the like is used, and the fixer may contain water soluble alkali metal salt, ammonium bromide or iodide such as potassium bromide, ammonium bromide, sodium iodide and the like described in Japanese Patent O.P.I. Publication No. 101934/1973.

Each process of film-prehardening, neutralization, rinsing and stabilizing may also be exercised in combination with the color developing and the bleach-fixing.

EXAMPLES

The typical examples embodying the present invention are described below. However, the scope of the preferred embodiments of the invention is not limited only to these examples.

Example - 1

Silver halide emulsion comprising silver chloro-bromide grains with an average grain size of 0.6 $\mu$m and involving uniformly distributed three mol % silver bromide was prepared by the double jet method. Sodium thiosulfate was added into the emulsion at a rate of $3.5\times10^{-6}$ mol per mol AgX, and, after one minute of the addition, chloroauric acid was added, at a rate of $2.7\times10^{-6}$ mol per mol AgX, into the emulsion, which was subjected to chemical ripening. Then the emulsion was divided into portions, whereby each spectral sensitizing dye (sensitizing dye of the invention or comparison sensitizing dye) listed in Table - 2 was added into each portion of emulsion at a rate of $3\times10^{-4}$ mol per mol AgX. Each of spectrally sensitized emulsion was further divided into portions, whereby some of the emulsions were left unchanged as indicated by Table - 2, while a mercapto compound of the invention or an example fogging restrainer listed in Table - 2 was added into each of the other ( emulsions at a rate of $1.2\times10^{-3}$ mol per mol AgX. In this way, the blue-sensitive silver chloro-bromide emulsions were prepared.

Each blue-sensitive silver chloro-bromide emulsion was applied to form a coat as one of the following photographic structural layers. This procedure prepared the samples listed in Table - 2.

More specifically, each sample was prepared in the following manner;

With a support made of paper with a specific gravity of 170 g/m$^2$ and having a lamination of polyethylene on one face thereof, and a lamination of polyethylene containing 11 weight % of anatase-type titanium dioxide on the other face thereof, the lamination of titanium dioxide-containing polyethylene was subjected to corona discharge, then, the following layers were formed thereon by coating. Additionally, each amount of addition is, unless otherwise specified, an amount per one m$^2$ sample Layer 1

A layer containing 1.2 g gelatin, 0.28 g (silver-converted value, hereinunder applicable) of the above-mentioned blue-sensitive silver chloro-bromide emulsion, as well as 0.50 g dinonyl phthalate (hereinafter referred to as DNP) in which 0.78 g yellow coupler (Y - 1), 0.35 g the following image stabilizer STB - 1 and 0.04 g antistain agent HQ - 1 having been dissolved.

Layer 2

An intermediate layer containing 0.7 g gelatin, as well as 0.05 g di-2-ethylhexyl phthalate (hereinafter referred to as DOP) in which 15 mg anti-irradiation dye (AI - 1), 10 mg anti-irradiation dye (AI - 2) and 0.05 g HQ - 1 having been dissolved.

Layer 3

A layer containing 1.25 g gelatin, 0.29 g of green-sensitive silver chloro-bromide emulsion (Note - 1: AgBr, 1.2 mol %; average grain size, 0.40 m) as well as 0.30 g DOP in which 0.45 g magenta coupler (M - 1), 0.8 g light-stabilizer STB - 2, 0.15 g light-stabilizer STB - 3 and 0.01 g HQ - 1 having been dissolved.

Layer 4

An intermediate layer containing 1.2 g gelatin, as well as 0.35 g DOP in which 0.08 g HQ - 1, 0.4 g ultraviolet absorbent (UV - 1) and 0.2 g ultraviolet absorbent (UV - 2) having been dissolved.

Layer 5

A layer containing 1.4 g gelatin, 0.20 g of red-sensitive silver chloro-bromide emulsion (Note - 2: AgBr, five mol %; average grain size, 0.65 m), as well as 0.20 g DOP in which 0.25 g cyan coupler (C - 1), 0.25 g cyan coupler (C - 2), 0.15 g light-stabilizer STB - 1 and 0.01 g HQ - 1 having been dissolved.

Layer 6

A layer containing 1.0 g gelatin, as well as 0.20 g DOP in which 0.30 g UV - 1 and 0.05 g polyvinyl pyrolidone having been dissolved.

Layer 7

A layer containing 0.05 g gelatin.

Additionally, as hardeners, the following were added correspondingly into emulsions for the layers, below, immediately before the coating process; sodium 2,4-dichloro-6-hydroxy-s-triazine for the above-mentioned layer, and a reaction product prepared by allowing (tetrakisvinylsulfonylmethyl)methane and taurine sodium to react at a molar ratio of 4:1.

C-1

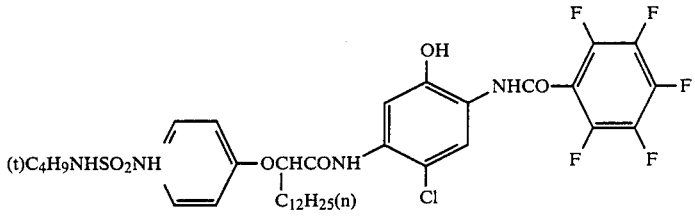

C-2

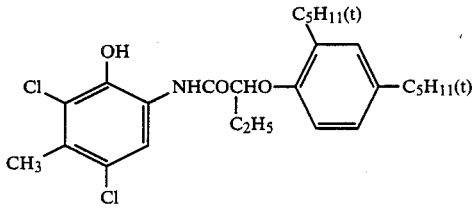

Y-1

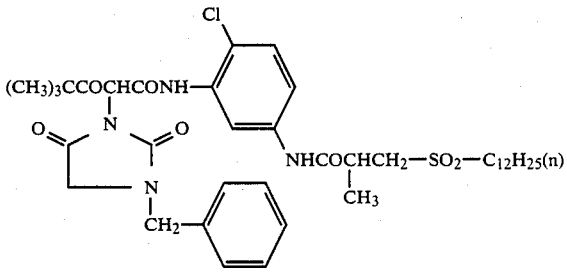

-continued
M-1
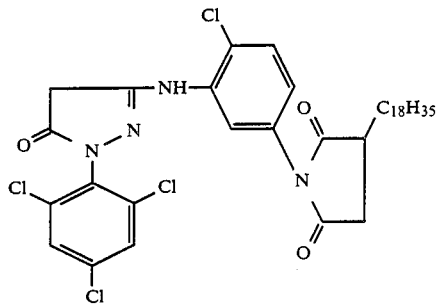
HQ-1
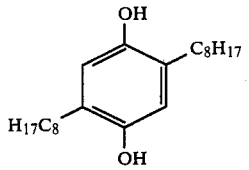
UV-1
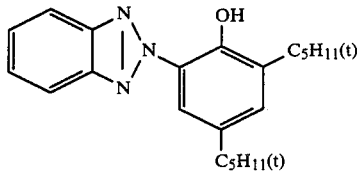
UV-2
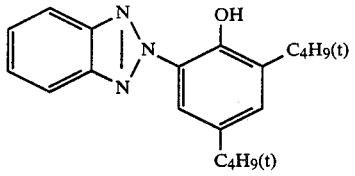
AI-1
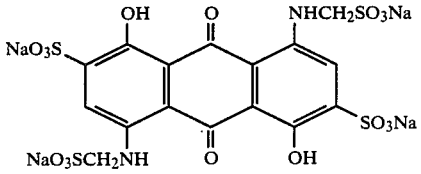
AI-2
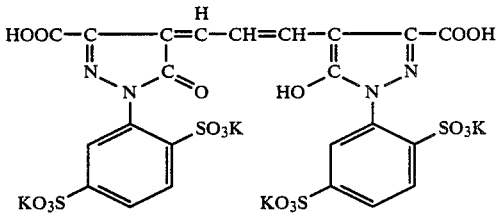
STB-1
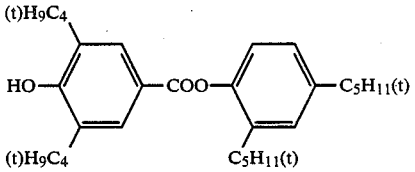
STB-2
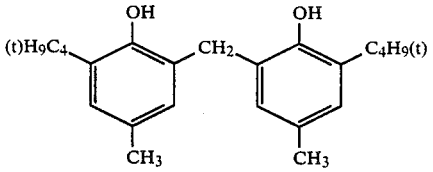

-continued

STB-3

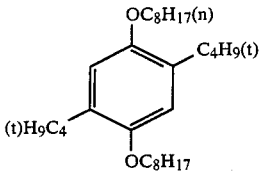

Comparison compounds (Comparison sensitizing dyes)

Comparison-A

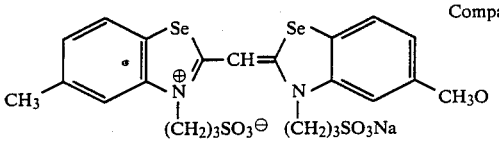

Comparison-B

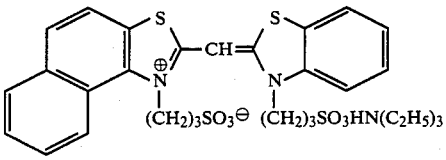

(Comparison fogging restrainers)

E

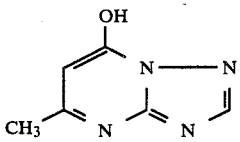

F

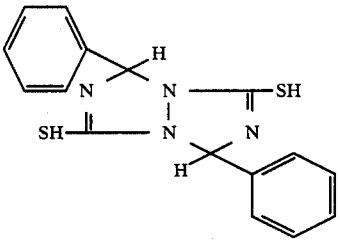

(Note-1): Green-sensitive silver chloro-bromide emulsion

Sodium thiosulfate was added into the emulsion at a rate of $3.5\times10^{-5}$ mol per mol silver halide in order to effect the chemical sensitization, whereby the optical sensitization was effected with green sensitizing dye (GSD - 1). Also 4-hydroxy-6-methyl-1,3,3a,7-tetrazaindene compound serving as a stabilizing agent was added into the emulsion at a rate of 1.2 g per mol silver halide.

(Note-2): Red-sensitive silver chloro-bromide emulsion

Sodium thiosulfate was added into the emulsion at a rate of $3.5\times10^{-3}$ mol per mol silver halide in order to effect the chemical sensitization, whereby the optical sensitization was effected with red sensitizing dye (RSD - 1). Also, 4-hydroxy-6-methyl-1,3,3a,7-tetrazaindene compound serving as a stabilizing agent was added into the emulsion at a rate of 1.2 g per mol silver halide.

GSD-1

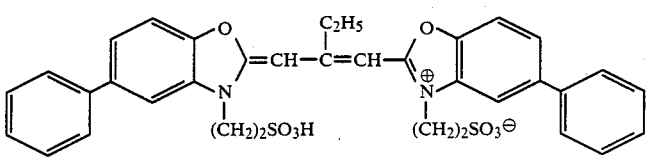

RSD-1

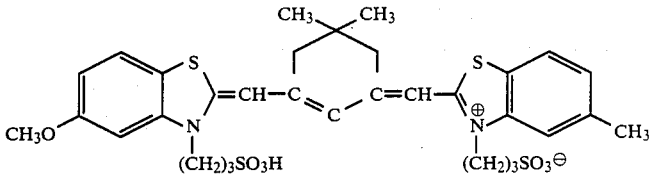

Each of the prepared samples was subjected to the stepwise exposing with white light, then treated in the processing steps specified below. Some of the samples were sorted under the conditions, a temperature of 50°, and relative humidity of 80% for six days, then subjected to the procedure mentioned above.

Processing steps

| | | |
|---|---|---|
| Color developing | 35° C. | 45 sec |
| Bleach-fixing | 35° C. | 50 sec |
| Washing | 30–34° C. | 90 sec |
| Drying | 50–70° C. | 60 sec |

The compositions of color developer and bleach-fixer used were as follows. (per one 1 solution)

(Color developer)

| | |
|---|---|
| Pure water | 800 ml |
| N,N—diethylhydroxylamine | 6 ml |
| Potassium sulfite | 2.0 g |
| N—ethyl-N—β-methanesulfonamidmethyl-3-methyl-4-aminoaniline sulfate | 5 g |
| Sodium tetrapolyphosphate | 2 g |
| Potassium carbonate | 30 g |
| Triethanol amine | 8.3 g |

Pure water was added into the above ingredients to prepared one 1 solution, and the pH value was adjusted to 10.08.

| | |
|---|---|
| Pure water | 800 ml |
| Ammonium ferric (III) ethylenediaminetetraacetate | 65 g |
| Bisodium ethylenediaminetetraacetate | 5 g |
| Ammonium thiosulfate | 85 g |
| Sodium metabisulfite | 2 g |
| Sodium chloride | 10 g |
| Hydroxylamine sulfate | 2 g |

Pure water was added into the above ingredients to prepare one 1 solution, and the pH value was adjusted to 6.2 with dilute sulfuric acid.

Using each of the developed samples, the density was measured with monochromatic blue light. Then, the sensitivity was determined based on the characteristic curve obtained from the density measurements. Additionally, each of undeveloped samples was developed, using the color developing time of 100 sec. so as to measure the fogging density.

The measured results are listed in Table - 2.

TABLE 2

| Sample No. | Sensitizing dye | Compound | Before storage Sensitivity | Before storage Fogging | After 6 days storage at 50° C., 80% RH Sensitivity | After 6 days storage at 50° C., 80% RH Fogging | Remarks |
|---|---|---|---|---|---|---|---|
| 1 | Comparison A | — | 100 | 0.20 | 50 | 0.40 | Comparison |
| 2 | Comparison B | — | 110 | 0.25 | 90 | 0.45 | " |
| 3 | I-12 | — | 130 | 0.24 | 110 | 0.44 | " |
| 4 | I-1 | — | 120 | 0.25 | 100 | 0.45 | " |
| 5 | I-5 | — | 115 | 0.25 | 95 | 0.45 | " |
| 6 | I-4 | — | 120 | 0.24 | 100 | 0.44 | " |
| 7 | Comparison B | E | 90 | 0.20 | 80 | 0.25 | " |
| 8 | Comparison B | F | 90 | 0.10 | 80 | 0.25 | " |
| 9 | Comparison B | II a-3 | 95 | 0.10 | 90 | 0.20 | " |
| 10 | Comparison B | II a-4 | 95 | 0.10 | 90 | 0.20 | " |
| 11 | Comparison B | II a-7 | 95 | 0.10 | 90 | 0.20 | " |
| 12 | I-12 | E | 120 | 0.20 | 100 | 0.25 | " |
| 13 | I-12 | II a-2 | 130 | 0.03 | 130 | 0.03 | Invention |
| 14 | I-12 | II a-4 | 130 | 0.03 | 130 | 0.03 | " |
| 15 | I-12 | II a-5 | 130 | 0.03 | 130 | 0.03 | " |
| 16 | I-1 | F | 110 | 0.20 | 105 | 0.25 | Comparison |
| 17 | I-1 | II a-1 | 120 | 0.02 | 118 | 0.02 | Invention |
| 18 | I-1 | II a-6 | 120 | 0.02 | 118 | 0.02 | " |
| 19 | I-1 | II a-8 | 120 | 0.02 | 118 | 0.02 | " |

Sensitivity is a relative sensitivity in proportion to the sensitivity, 100, of sample No. 1.

The results in Table - 2 illustrate the following.

With the samples 1 through 6, it is apparent that spectral sensitizing dyes independently having two benzothiazole nuclei are highly sensitive to AgCl, however, they show not only serious fogging, but desensitization and more severe fogging due to the results of extended storage. Results are obtained by comparing the sample No. 1 containing a sensitizing dye having benzosolenazole nuclei with each of the samples No. 2 through 6 independently having benzothiazole nuclei.

In samples No. 7 to No. 19, spectral sensitizing dyes having a benzothiazole nucleus were used and the compounds were added for restraining fog-desensitization before and after storage. In samples No. 9 to No. 11, among the samples, using the comparative spectral sensitizing dye having a benzthiazole nucleus and a naphtothiazole nucleus, even when adding the compound of the invention, desensitization caused by storage was a little reduced, however, desensitization before storage and fog increase before and after storage were still caused. Additionally, with a sample having a compound other than that of the invention, the pre-storage desensitization is quite significant. Though comparable to the samples according to the invention in terms of the degree of desensitization by storage, some of the comparison samples containing the other compound than those of the invention do not have fog-restraining effects. Also, though comparable to the samples of the invention in terms of fog-restraining effects, some of the comparison samples show worse desensitization. In short, there is no comparison sample which is more effective than a sample having a compound of the invention.

Even with the samples No. 12 through 19 having a spectral sensitizing dye of the invention, a sample having a compound other than that of the invention shows the difference between the pre-storage and post-storage fogging sensitivities. In contrast, it is apparent that each of the samples No. 13 through 15 and samples No. 17 through 19 having both a sensitizing dye of the invention and a compound of the invention not only maintains an original sensitivity to which level it was sensitized with a spectral sensitizing dye, and features low fogging, but has the effects of dye and compound well maintained even after a prolonged storage. These resultant effects cannot be readily expected from the effects obtainable from the independent use of a sensitizing dye of the invention or a compound of the invention.

Example - 2

The procedure for Example - 2 was carried out in a manner identical to that of Example - 1, except that spectral sensitizing dyes (each amount of addition was same as in Example - 1) and compounds (each amount of addition of compound was at a rate of $6.0\times10^{-4}$ mol per mol AgX) both listed in Table - 3 were used. The results are as so listed in Table - 3.

As can be understood from the results in Table - 3, though the amounts of addition were modified from those in Example - 1, the samples independently having both a spectral sensitizing dye of the invention and a compound of the formula [IIb], which is a mercapto compound of the invention, successfully achieved the results identical to those of the Examples - 1.

TABLE 3

| Sample No. | Sensitizing dye | Compound | Before storage Sensitivity | Before storage Fogging | After 6 days storage at 50° C., 80% RH Sensitivity | After 6 days storage at 50° C., 80% RH Fogging | Remarks |
|---|---|---|---|---|---|---|---|
| 20 | Comparison B | II b-2 | 100 | 0.10 | 95 | 0.20 | Comparison |
| 21 | Comparison B | II b-4 | 100 | 0.10 | 95 | 0.20 | " |
| 22 | I-12 | II b-2 | 130 | 0.02 | 130 | 0.20 | Invention |
| 23 | I-12 | II b-5 | 130 | 0.02 | 130 | 0.02 | " |
| 24 | I-12 | II b-6 | 130 | 0.02 | 130 | 0.02 | " |
| 25 | I-12 | II b-7 | 125 | 0.03 | 123 | 0.03 | " |
| 26 | I-12 | II b-8 | 132 | 0.02 | 130 | 0.02 | " |
| 27 | I-12 | II b-9 | 128 | 0.02 | 129 | 0.03 | " |
| 28 | I-5 | II b-1 | 113 | 0.03 | 113 | 0.03 | " |
| 29 | I-5 | II b-2 | 115 | 0.03 | 114 | 0.03 | " |
| 30 | I-5 | II b-4 | 113 | 0.03 | 113 | 0.03 | " |
| 31 | I-17 | II b-2 | 118 | 0.02 | 115 | 0.02 | " |
| 32 | I-17 | II b-8 | 115 | 0.02 | 116 | 0.02 | " |

Example - 3

The procedure for Example - 3 was carried out in a manner identical to that of Example - 1, except that spectral sensitizing dyes (each amount of addition was same as in Example - 1) and compounds (amount of addition was $5.8\times10^{-4}$ mol/mol AgX) both listed in Table - 4 were used. The results are also listed in Table - 4.

It was learned that the results identical to those of Example - 1 are achieved by a combination of a sensitizing dye of the invention and a mercapto compound of the invention represented by the formula. Listed sensitivities are values relative to the pre-storage sensitivity of sample 33 which is assumed to be 100.

TABLE 4

| Sample No. | Sensitizing dye | Compound | Before storage Sensitivity | Before storage Fogging | After 6 days storage at 50° C., 80% RH Sensitivity | After 6 days storage at 50° C., 80% RH Fogging | Remarks |
|---|---|---|---|---|---|---|---|
| 33 | Comparison B | II c-8 | 100 | 0.10 | 95 | 0.20 | Comparison |
| 34 | Comparison B | II c-13 | 100 | 0.10 | 95 | 0.20 | " |
| 35 | Comparison B | II c-16 | 100 | 0.10 | 95 | 0.20 | " |
| 36 | I-12 | II c-1 | 130 | 0.03 | 130 | 0.03 | Invention |
| 37 | I-12 | II c-6 | 130 | 0.03 | 130 | 0.03 | " |
| 38 | I-12 | II c-8 | 130 | 0.03 | 130 | 0.03 | " |
| 39 | I-12 | II c-13 | 130 | 0.03 | 130 | 0.03 | " |
| 40 | I-12 | II c-14 | 130 | 0.03 | 130 | 0.03 | " |
| 41 | I-2 | II c-1 | 120 | 0.02 | 119 | 0.02 | " |
| 42 | I-2 | II c-8 | 120 | 0.02 | 119 | 0.02 | " |
| 43 | I-2 | II c-16 | 120 | 0.02 | 119 | 0.02 | " |

Example - 4

The procedure for Example - 4 was carried out in a manner identical to that of Example - 1, except that spectral sensitizing dyes (each amount of addition was same as in Example - 1) and compounds (amount of addition was $7.0\times10^{-4}$ mol/mol AgX) both listed in Table - 5 were used. The results are also listed in Table - 5.

It was learned that the results identical to those of Example - 1 are achieved by a combination of a sensitizing dye of the invention and a mercapto compound of the invention represented by the formula. Listed sensitivities are values relative to the pre-storage sensitivity of sample 33 which is assumed to be 100.

TABLE 5

| Sample No. | Sensitizing dye | Compound | Before storage Sensitivity | Before storage Fogging | After 6 days storage at 50° C., 80% RH Sensitivity | After 6 days storage at 50° C., 80% RH Fogging | Remarks |
|---|---|---|---|---|---|---|---|
| 44 | Comparison B | II d-1 | 100 | 0.10 | 95 | 0.20 | Comparison |
| 45 | Comparison B | II d-4 | 100 | 0.10 | 95 | 0.20 | " |
| 46 | I-12 | II d-9 | 130 | 0.02 | 130 | 0.02 | Invention |

TABLE 5-continued

| Sample No. | Sensitizing dye | Compound | Before storage Sensitivity | Before storage Fogging | After 6 days storage at 50° C., 80% RH Sensitivity | After 6 days storage at 50° C., 80% RH Fogging | Remarks |
|---|---|---|---|---|---|---|---|
| 47 | I-12 | II d-2 | 130 | 0.02 | 130 | 0.02 | " |
| 48 | I-12 | II d-13 | 130 | 0.02 | 130 | 0.02 | " |
| 49 | I-6 | II d-9 | 115 | 0.03 | 114 | 0.03 | " |
| 50 | I-6 | II d-6 | 113 | 0.03 | 111 | 0.04 | " |
| 51 | I-6 | II d-12 | 115 | 0.03 | 114 | 0.03 | " |

Example - 5

The procedure for Example - 5 was carried out in a manner identical to that of Example - 1 except that spectral sensitizing dyes (each amount of addition was same as in Example - 1) and compounds (amount of addition was $8.2\times10^{-5}$ mol/mol AgX) both listed in Table - 6 were used. The results are also listed in Table - 6.

It was learned that the results identical to those of Example - 1 are achieved by a combination of a sensitizing dye of the invention and a mercapto compound of the invention represented by the formula. Listed sensitivities are relative to the pre-storage sensitivity of sample 52 which is assumed to be 100.

TABLE 6

| Sample No. | Sensitizing dye | Compound | Before storage Sensitivity | Before storage Fogging | After 6 days storage at 50° C., 80% RH Sensitivity | After 6 days storage at 50° C., 80% RH Fogging | Remarks |
|---|---|---|---|---|---|---|---|
| 52 | Comparison B | II e-4 | 100 | 0.10 | 95 | 0.20 | Comparison |
| 53 | Comparison B | II e-6 | 100 | 0.10 | 95 | 0.20 | " |
| 54 | I-12 | II e-2 | 125 | 0.02 | 124 | 0.03 | Invention |
| 55 | I-12 | II e-4 | 125 | 0.02 | 125 | 0.02 | " |
| 56 | I-12 | II e-6 | 125 | 0.02 | 125 | 0.03 | " |
| 57 | I-2 | II e-1 | 120 | 0.03 | 118 | 0.04 | " |
| 58 | I-2 | II e-3 | 120 | 0.03 | 118 | 0.04 | " |
| 59 | I-2 | II e-7 | 120 | 0.03 | 118 | 0.03 | " |

Example - 6

The procedure for Example - 6 was carried out in a manner identical to that of Example - 1, except that spectral sensitizing dyes (each amount of addition was same as in Example - 1) and compounds (amount of addition was $3.0\times10^{-5}$ mol/mol AgX) both listed in Table - 7 were used. The results are also listed in Table - 7.

It is apparent from the results in Table - 7 that the results identical to those of Example - 1 are achieved by a combination of a sensitizing dye of the invention and a mercapto compound of the invention represented. Listed sensitivities are values relative to the pre-storage sensitivity of sample 60 which is assumed to be 100.

TABLE 7

| Sample No. | Sensitizing dye | Compound | Before storage Sensitivity | Before storage Fogging | After 6 days storage at 50° C., 80% RH Sensitivity | After 6 days storage at 50° C., 80% RH Fogging | Remarks |
|---|---|---|---|---|---|---|---|
| 60 | Comparison B | II f-1 | 100 | 0.10 | 95 | 0.20 | |
| 61 | Comparison B | II f-4 | 100 | 0.10 | 95 | 0.20 | |
| 62 | I-12 | II f-1 | 120 | 0.02 | 120 | 0.02 | |
| 63 | I-12 | II f-5 | 120 | 0.02 | 120 | 0.02 | |
| 64 | I-12 | II f-6 | 120 | 0.02 | 120 | 0.02 | |
| 65 | I-1 | II f-1 | 120 | 0.03 | 119 | 0.03 | |
| 66 | I-1 | II f-4 | 120 | 0.03 | 119 | 0.03 | |
| 67 | I-1 | II f-5 | 120 | 0.03 | 119 | 0.03 | |

Example - 7

The procedure for Example - 7 was carried out in a manner identical to that of Example - 1, except that combinations, as listed in Table - 8, of sensitizing dye and compound was used, and that some of the samples were stored for seven days under the conditions of 50° C. and 32 % RH. Listed sensitivities are values relative to the pre-storage sensitivity of sample 60 which is assumed to be 100.

Under a high-temperature, low-humidity storing conditions, the increase both in sensitivity and fogging is apparent. Even among samples having a compound of the invention, sample 69, for example, also having a sensitizing dye not in compliance with the invention shows insufficiently inhibited increase both in sensitivity and fogging. In contrast, it is apparent that the samples individually having both the sensitizing dye of the invention and the compound of the invention feature reduced variation both in sensitivity and fogging. This means the samples of the invention respectively have improved shelf life. In particular, it is apparent that the use of a compound represented by any of the variations of general formula [II b] is especially effective in inhibiting the increase in fogging.

With each of samples Nos. 69, 72 and 80, two types of samples, that is, pre-storage and post-storage samples, were exposed through a color negative film, and subjected to the developing described in Example - 1. Each of the pre-storage samples, samples 72 and 80, provided a satisfactory color print, though sample 69 appeared rather yellowish. In contrast, the post-storage sample No. 69 provided a poor color print whose overall area was yellowish. Either sample 72 or 80, whichever after or before storage, provided color prints whose image quality being equal with each other.

It was learned by thorough examination on a white area of a print prepared with a sample either 72 or 80 that, though both samples were identical to each other in terms of fogging, sample 72 was a little more yellowish. The possible cause of this result is that a sensitizing dye remain unremoved in a developed light-sensitive material. In essence it was learned that, among sensitizing dyes represented by the general formula [I], a sensitizing dye having alkyl groups represented respectively by $R_1$ and $R_2$ one of which being a sulfoalkyl group and another being a carboxyalkyl group is especially advantagoues in terms of rapid processing.

TABLE 8

| Sample No. | Sensitizing dye | Resprainer Compound | Resprainer Amount of addition | Before storage Sensitivity | Before storage Fogging | After 7 days storage at 50° C., 32% RH Sensitivity | After 7 days storage at 50° C., 32% RH Fogging | Remarks |
|---|---|---|---|---|---|---|---|---|
| 68 | Comparison B | E | $1.2 \times 10^{-3}$ | 100 | 0.10 | 125 | 0.35 | Comparison |
| 69 | Comparison B | II b-5 | $6.0 \times 10^{-4}$ | 102 | 0.09 | 118 | 0.25 | " |
| 70 | I-1 | E | $1.2 \times 10^{-3}$ | 105 | 0.18 | 130 | 0.37 | " |
| 71 | I-1 | II a-8 | $1.2 \times 10^{-3}$ | 130 | 0.02 | 133 | 0.03 | Invention |
| 72 | I-1 | II b-5 | $6.0 \times 10^{-4}$ | 130 | 0.02 | 131 | 0.02 | " |
| 73 | I-1 | II b-9 | $6.0 \times 10^{-4}$ | 132 | 0.02 | 131 | 0.02 | " |
| 74 | I-1 | II c-1 | $5.8 \times 10^{-4}$ | 127 | 0.02 | 129 | 0.04 | " |
| 75 | I-1 | II d-9 | $7.0 \times 10^{-4}$ | 132 | 0.03 | 135 | 0.03 | " |
| 76 | I-1 | II e-4 | $8.2 \times 10^{-5}$ | 131 | 0.03 | 132 | 0.04 | " |
| 77 | I-1 | II f-1 | $2.0 \times 10^{-4}$ | 130 | 0.02 | 136 | 0.05 | " |
| 78 | I-12 | E | $1.2 \times 10^{-3}$ | 110 | 0.18 | 135 | 0.36 | Comparison |
| 79 | I-12 | II a-8 | $1.2 \times 10^{-3}$ | 127 | 0.03 | 131 | 0.04 | Invention |
| 80 | I-12 | II b-5 | $6.0 \times 10^{-4}$ | 130 | 0.02 | 130 | 0.02 | " |
| 81 | I-12 | II b-9 | $6.0 \times 10^{-4}$ | 131 | 0.02 | 133 | 0.02 | " |
| 82 | I-12 | II c-1 | $5.8 \times 10^{-4}$ | 128 | 0.03 | 131 | 0.04 | " |
| 83 | I-12 | II d-9 | $7.0 \times 10^{-4}$ | 132 | 0.02 | 132 | 0.04 | " |
| 84 | I-12 | II e-4 | $8.2 \times 10^{-5}$ | 130 | 0.02 | 133 | 0.03 | " |
| 85 | I-12 | II f-1 | $2.0 \times 10^{-4}$ | 130 | 0.02 | 136 | 0.05 | " |

What is claimed is:

1. A silver halide photographic light-sensitive material comprising a support having thereon at least one silver halide emulsion layer comprising
   (a) silver halide grains comprising not less than 95 mol % of silver chloride,
   (b) at least one optical sensitizing dye represented by the following general formula I, and
   (c) at least one compound represented by the following general formula II:

General formula I

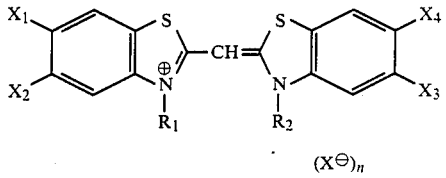

wherein $X_1$, $X_2$, $X_3$ and $X_4$ are a hydrogen atom, a halogen atom, an alkyl group, an alkoxy group, an aryl group or a hydroxy group; $R_1$ and $R_2$ are an alkyl group; $X\ominus$ is a counter anion and n is 0 or 1, General formula II

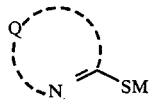

wherein Q is an atomic group necessary for completing a five-membered heterocylic ring, a five-membered heterocylic ring condensed with a benzene ring or a 1,3,5-triazine ring and M is a hydrogen atom, an alkali atom or an ammonium group.

2. The silver halide photographic light-sensitive material of claim 1, wherein Q of the general formula [II] is an atomic group necessary for completing a five-membered heterocyclic ring or a five-membered heterocyclic ring condensed with a benzene ring.

3. The silver halide photographic light-sensitive material of claim 1, wherein Q of the general formula [II] is an atomic group necessary for completing a tetrazole ring, 1,3,4-oxadiazole ring, 1,3,4-diazole ring or 1,3,4-triazole ring.

4. The silver halide photographic light-sensitive material of claim 1 wherein Q of the general formula [II] is an atomic group necessary for completing a tetrazole ring.

5. The silver halide photographic light-sensitive material of claim 1, wherein said silver halide emulsion layer contains said optical sensitizing dye represented by the general formula [I] in an amount of from $5\times10^{-6}$ to $5\times10^{-2}$ mol per mol of silver halide contained in said silver halide emulsion layer.

6. The silver halide photographic light-sensitive material of claim 1, wherein said silver halide emulsion layer contains said compound represented by the general formula [II] in an amount of from $1\times10^{-6}$ to $1\times10^{-1}$ mol per mol of silver halide contained in said silver halide emulsion layer.

7. The silver halide photographic light-sensitive material of claim 1, wherein said silver halide emulsion layer contains said silver halide grains comprising not less than 95 mol % of silver chloride in an amount of not less than 80% by weight to the total weight of silver halide grains contained said silver halide emulsion layer.

8. The silver halide photographic light-sensitive material of claim 7, wherein the whole silver halide grain contained in said silver halide emulsion layer is said silver halide grain comprising not less than 95 mol % of silver chloride.

9. The silver halide photographic light-sensitive material of claim 1, wherein the average silver chloride content of the whole silver halide grain contained in said silver halide emulsion layer is not less than 95 mol %.

10. The silver halide photographic light-sensitive material of claim 1, said silver halide emulsion layer contains a gold compound in an amount of from $5\times10^{-7}$ to $5\times10^{-3}$ mol per mol of silver halide contained in said emulsion layer.

11. The silver halide photographic light-sensitive material of claim 1, said silver halide emulsion layer contains a sulfur sensitizer

12. The silver halide photographic light-sensitive material of claim 1, wherein said silver halide emulsion contains a gold compound and a sulfur sensitizer.

* * * * *